US005556102A

United States Patent [19]

Huang

[11] Patent Number: 5,556,102

[45] Date of Patent: Sep. 17, 1996

[54] APPARATUS AND METHOD OF PLAYING A WORD COMPOSITION GAME WHERE COMPASS DIRECTION ASSIGNED TO EACH PLAYER AND THE TIME WHEN THE GAME IS PLAYED AFFECTS GAME PLAY

[76] Inventor: Pingsheng Huang, 20 Alpine Rd., Towaco, N.J. 07082

[21] Appl. No.: 380,818

[22] Filed: Jan. 30, 1995

[51] Int. Cl.[6] ..... A63F 1/00; G09B 19/22

[52] U.S. Cl. ..... 273/299; 434/172

[58] Field of Search ..... 273/299, 272; 434/172, 171, 167

[56] References Cited

U.S. PATENT DOCUMENTS

| | | | |
|---|---|---|---|
| 244,745 | 7/1881 | Goldey | 273/299 |
| 2,071,014 | 2/1937 | Akers | 273/299 |
| 3,678,602 | 7/1972 | Alam | 273/299 |
| 4,219,197 | 8/1980 | Acuff | 273/299 |

*Primary Examiner*—Benjamin H. Layno

[57] ABSTRACT

A word composition game system is disclosed. The system comprises a set of playing pieces, each having a plurality of wording groups. Each player is assigned a unique compass direction of North, East, South or West. Based on a commonly acknowledged word category and gaming level, players compose words with the received playing pieces. The time of when the game is played and the unique compass direction assigned to each player are incorporated into the game. Certain playing pieces have wording groups representing different periods of time during the calendar year and other playing pieces have wording groups representing different directions defined by a compass. The players that receive playing pieces having the period of time corresponding to the time of when the game is played, and the players that receive playing pieces having the compass direction corresponding to their assigned compass direction, respectively, can use these playing pieces to substitute the missing letters in composing a word. Each play has the equal opportunity to dispose the unwanted pieces for new ones. Therefor strategies in disposing and composing words must be employed in the game.

5 Claims, 13 Drawing Sheets

| | | | |
|---|---|---|---|
| **A**<br>AB<br>AP | **A**<br>AD<br>AT | **A**<br>AL<br>AR | **A**<br>AN<br>AM |
| **C**<br>CL<br>CR | **C**<br>CO<br>CON<br>COM | **C**<br>CA<br>CU | **C**<br>CH<br>CE |
| **E**<br>EL<br>ER | **E**<br>EQ<br>EV | **E**<br>EX<br>ES | **E**<br>EN<br>EM |
| **G**<br>GE<br>DGE | **G**<br>GA<br>GU | **G**<br>GL<br>GR | **G**<br>GO<br>GEN |
| **I**<br>IR<br>IL | **I**<br>IN<br>IM | **I**<br>ID<br>IT | **I**<br>IS<br>IC |
| **K**<br>KI<br>KIN | **K**<br>KA | **K**<br>KE<br>KI | **K**<br>KN |
| **M**<br>MA<br>MAN | **M**<br>MIS<br>MI | **M**<br>MO<br>MON<br>MOU | **M**<br>ME<br>MEA |

| | | | |
|---|---|---|---|
| **B**<br>BE<br>BI | **B**<br>BA<br>BAN<br>BAM | **B**<br>BL<br>BR | **B**<br>BO<br>BU |
| **D**<br>DI<br>DIS | **D**<br>DO<br>DU | **D**<br>DR<br>DL | **D**<br>DE<br>DES |
| **F**<br>FL<br>FR | **F**<br>FO<br>FOO<br>FOR | **F**<br>FA<br>FAC<br>FAR | **F**<br>FI<br>FE |
| **H**<br>HA<br>HAL | **H**<br>HO<br>HU | **H**<br>HE<br>HEA | **H**<br>HI<br>HY |
| **J**<br>JO | **J**<br>JE | **J**<br>JA | **J**<br>JU |
| **L**<br>LI<br>LY | **L**<br>LO<br>LU | **L**<br>LE<br>LEA | **L**<br>LA<br>LAN<br>LAM |
| **N**<br>NO<br>NON | **N**<br>NE | **N**<br>NA | **N**<br>NI<br>NU |

*Fig. 4(a)*

APPARATUS AND METHOD OF PLAYING A WORD COMPOSITION GAME WHERE COMPASS DIRECTION ASSIGNED TO EACH PLAYER AND THE TIME WHEN THE GAME IS PLAYED AFFECTS GAME PLAY

FIELD OF INVENTION

The present invention relates to word spelling games to facilitate the learning of word spelling and the entertaining of family members and social gathering, and more particularly relates to word composition competition with players' competitive strategy involved.

BACKGROUND OF THE RELATED ART

There have been many word spelling-based games devised in the past. English, a daily living language in U.S., is alphabetic and therefore the purpose of many word spelling games are to help beginners to the language to learn word spelling. To stimulate the beginners' interests for word spelling, some of the games involve score accumulation if words are spelled correctly, others utilize age-dependent categories such as colors, fruits or animals for spelled words within the predefined categories. The added means in a word spelling game has been proved quite appearing to most of the beginners.

U.S. Pat. No. 3,678,602 to Anthony A. Alam in 1972 discloses a vocabulary building card game in which two or more decks of cards are used. Each card, on one side, bears word parts within defined word classification such as prefix, root or affix and, on the other side, displays the respective word classification. The cards are classified based on their word parts and kept in a card dealing holder. Players withdraw the cards from the dealing holder and try to spell the word based on the received cards showing the morpheme.

U.S. Pat. No. 5,310,347 to Chester Brand in 1994 discloses a card game comprising two decks of cards, one being a numbered deck and the other being a word deck. Players play the numbered cards and are then commanded to spell a word from a card withdrawn from the word deck having a length equal to the additive sum of the numbered cards played.

The above disclosed games and many others in commercial markets were designed to help beginners to learn word spelling and to stimulate their learning interests by appending additional challenge means, such as associated numerical means to score the spelling games. As it can be seen, the scoring result or the gaming is very much dependent on the cards or playing pieces received. A player's spelling capability and his personal gaming strategy have no control over the playing pieces once received. In other words, cards are once received by the player and some "lucky" cards in hand determine in general the final result immediately.

In many occasions, players, especially adults or elderly, play a spelling game not just for word spelling entertainment but more for social entertainment, or individual strategic competition or even gambling. There is therefore a great need for such a game in which players have a control power over what they receive in their hands and then design strategically to compete with the opposing players in composing words. There has further been a great need for such a spelling game to become a competition instrument for individual strategy competition or gambling. There also has been a need in the art for a game of word spelling for less sophisticated players who may have a limited knowledge of word for spelling, the game can be easily redefined among the players accordingly to meet the need.

SUMMARY OF THE INVENTION

The present invention has been made in consideration of the above described problems and needs. The disclosed gaming system involves highly strategic competition and may be played by a group of 2, 3, 4 people. Although a higher number of people can still play the game based on the word spelling, the chance of a tie or even result may occur as fewer chances are left for the players to make word composition. The prefer number of players is 4 people or less as the following embodiment is configured for 4 players.

According to one aspect of the invention, the disclosed gaming system comprises a set of playing pieces. The playing pieces are usually blocks as they can stand up stably on a flat surface by themselves. Every playing piece or block bears a number of wording groups. Each players first receive a certain number of the blocks from a shuffled pool of the blocks and keep these received blocks from the view of others. Based on a set of rules as to be described in the following, each player composes a fixed number of words in a predefined category with one of the wording groups in the received blocks and determines what blocks to discard or what to exchange for new blocks till all blocks in hand are used to compose the fixed number of words. Then players take turns to deal, one at a time, with the unwanted blocks and receive a new one every time an unwanted one is displayed and returned to the pool. The deal action is defined herewithin as disposing a unwanted block and receiving a new block. The number of blocks received by a player is always the same, namely every time the player disposes a block he must receive a new one from the pool or a disposed one by the opposing party dealing just ahead of him. The player may strategically dispose a one which the opposing party may take in, hence to increase the difficulty of composing words by the opposing party with the received blocks. The goal of each player is to get a set of words composed by the blocks received with no isolated blocks left. As it becomes clear in the following description each player has the same opportunity to discard his unwanted blocks for new ones, every player must act aggressively and strategically to recompose words every time a new one is received to achieve the goal himself first. Therefore the game involves players' strategic competition and initially received blocks may not be able to determine the final results.

Therefore an important object of the present invention is to provide a generic word spelling entertaining instrument to all ages who know alphabetic words of different level.

It is another object of the present invention to provide an improved word spelling game for all ages to learn word spelling and composition.

It is still another object of the present invention to provide an entertaining instrument to stimulate beginners to learn word spelling and new words.

It is still another object of the present invention to provide an entertaining instrument to all aged for strategic competition.

Other objects, together with the foregoing are attained in the exercise of the invention in the following description and resulting in the embodiment illustrated in the accompanying drawing.

DETAILED DESCRIPTION OF THE INVENTION

Figure 1:
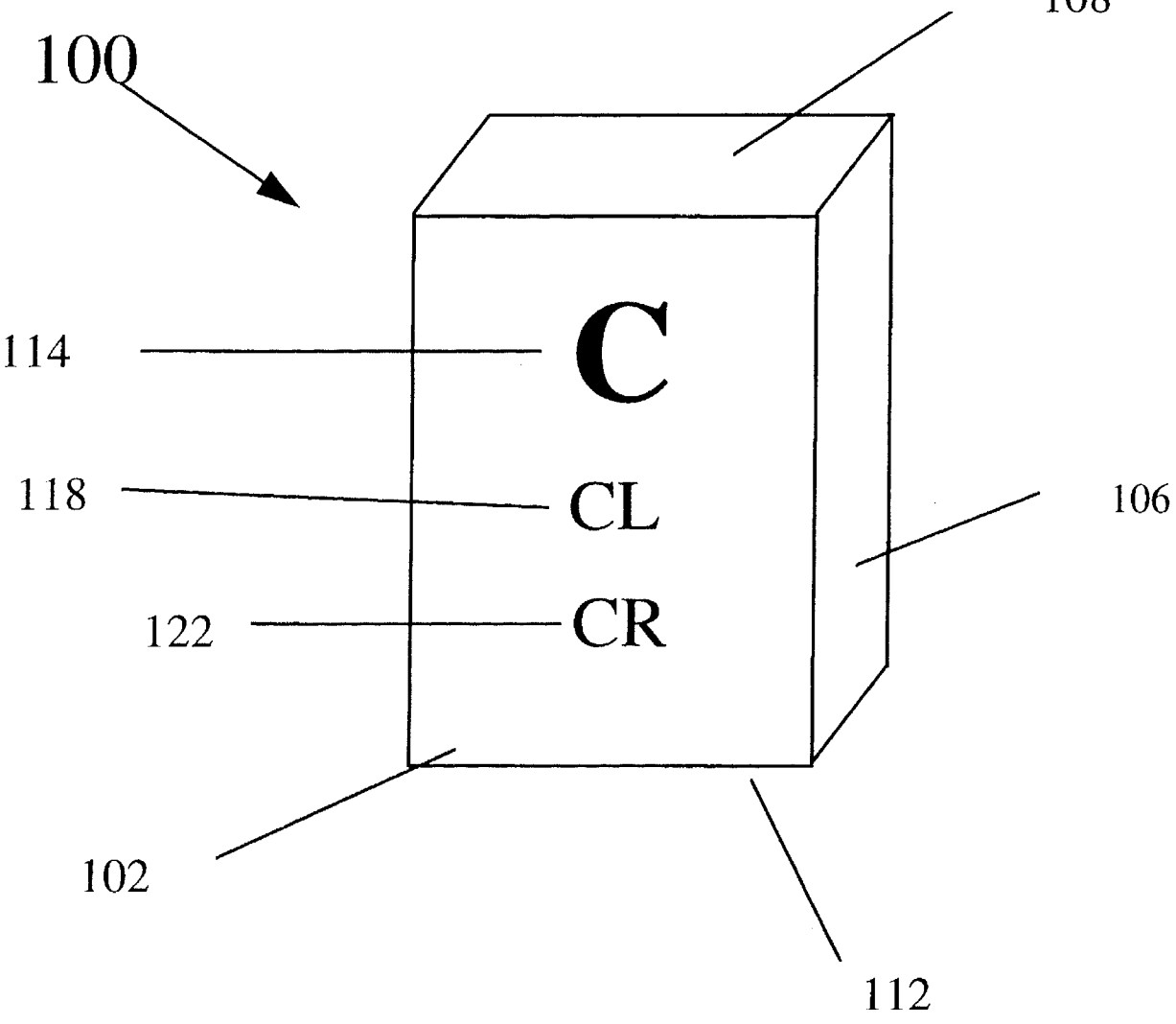
FIG. 1 shows a perspective view of a block with a front surface showing three wording groups used to compose an English word in the gaming system.
Figure 2:
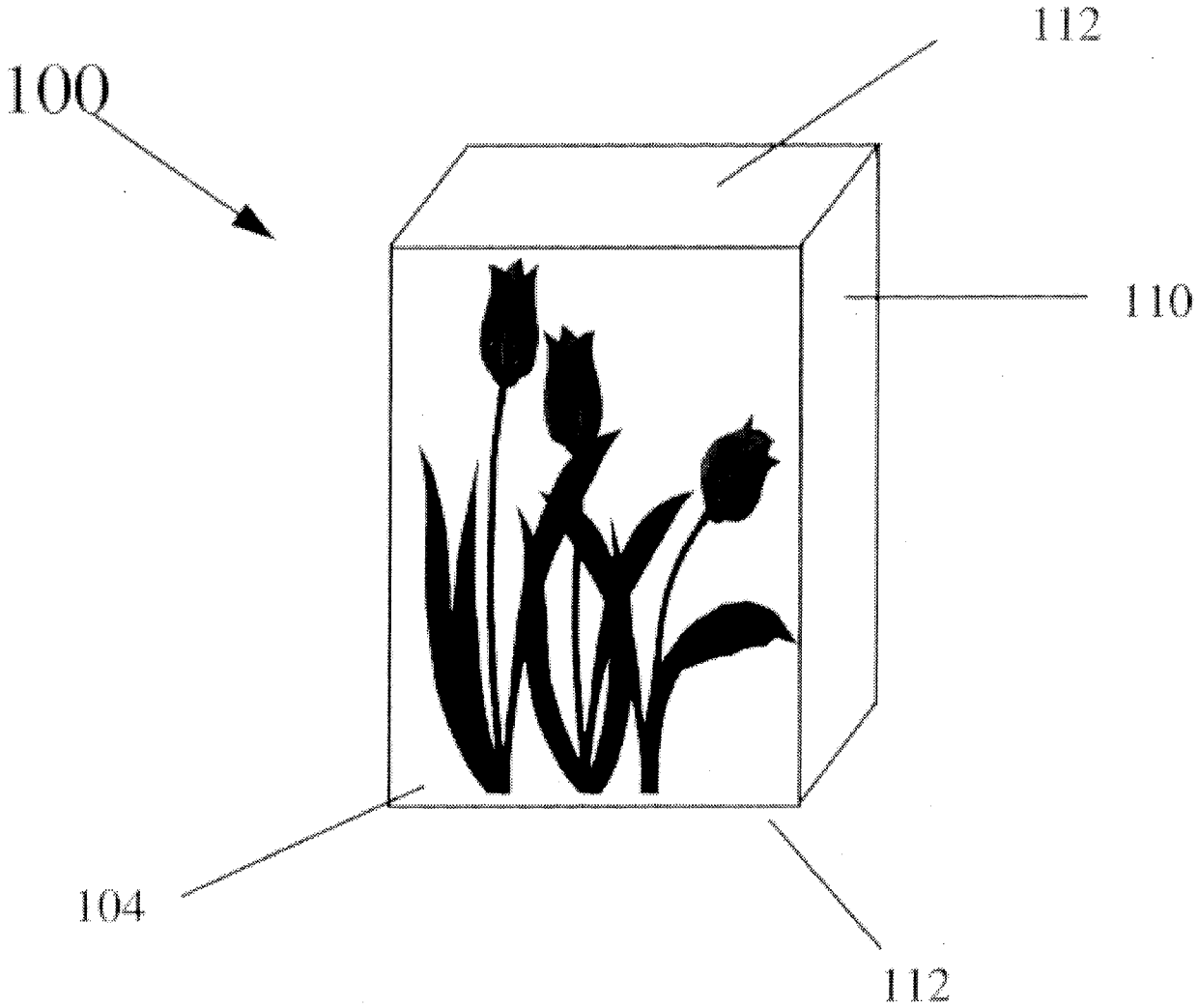
FIG. 2 shows a back view of the same block with an ornamental back surface displayed.

Referring now to the drawings, in which like numerals refer to like parts throughout the several views, FIG. 1 shows a perspective view of a block 100 having a shape of rectangular parallelepiped with six flat surfaces with 102, 106, and 108 displayed. FIG. 2 shows a back view of the block 100 with three surfaces 104, 108 and 110 displayed. Surface 112 faces downward and is not displayed. The gaming system comprises a set of such blocks, each having two major surfaces 102 and 104, one being a front surface 102 and the other being a back surface 104. The front surface 102 as shown in FIG. 1 is used to display the alphabetic information thereon in a wording group for word composition. The back surface 104 is used to decorate the blocks, therefore the back surfaces of all blocks have the same ornamental appearance as shown in FIG. 2 in which a bunch of roses is displayed to indicate the orientation of the block. It should be understood to those skilled in the art that any ornamental graphics can be used, but an ornamental graphics having an inherent orientation is preferred. The number of such blocks in the gaming apparatus is designated to 144 pieces as the embodiment is implemented for English words and preferably for four players or less. It will be understood to those skilled in the art that the number of blocks 144 can be altered as the language is changed.

Figure 3:
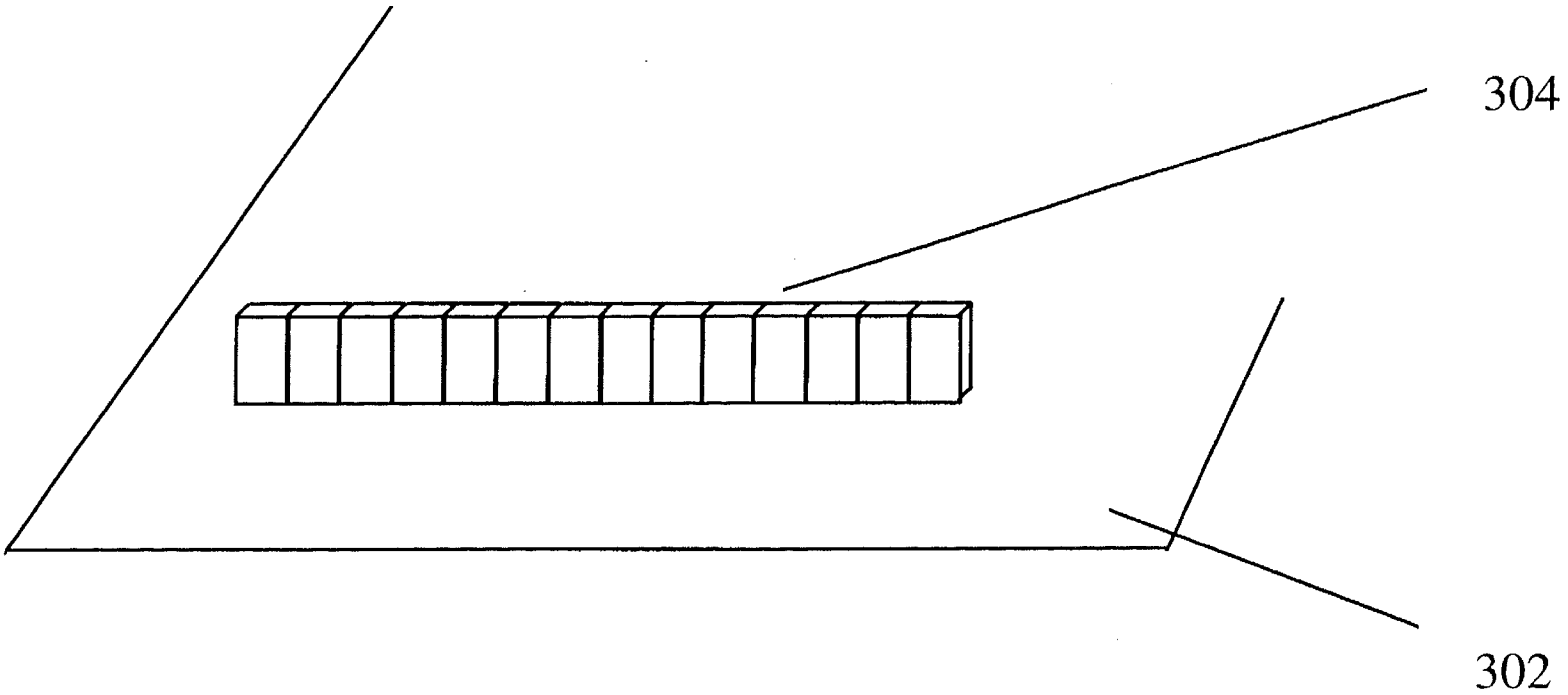
FIG. 3 shows a row of 14 blocks standing up on a flat surface.

The blocks are preferably made out of plastic material, wood or any solid material. The solidity of the blocks enables each individual block to stand up stably on a flat surface for players to reposition the block in composing words and even possibly to create a sound to stimulate the gaming when the blocks hit each other. In addition, it is possible to have a row of such blocks to stand up simultaneously from a lying position by holding only both ends of the row. FIG. 3 shows a row of 14 blocks 304 standing up on a flat surface 302. With all blocks standing up and facing to the player, it makes it easy for the player to visualize and plan all the possibilities of composing words with all the received blocks.

There are a number of wording groups displayed in lines in the front surface 102 of the block 100. Preferably there is at least one wording group which has a clear indication in an obvious position of the front surface 102. FIG. 1 shows one such wording group, called the first wording group indicated by 114, an English alphabet "C". There are also two other wording groups by 118 and 112 under the first wording group 114 in FIG. 1, each showing a combination of a few alphabets most used in English words. The wording groups except the first group are in fact the smallest wording base for a meaningful word of over three alphabets or letters. One of the objectives of playing the game is to compose a word based on one of the wording groups, certainly with a set of rules to be described in sequel. The color of the first wording group should be different from those of the other wording groups for easy classification. No colors are shown in any figure of any drawing.

Figure 4B:
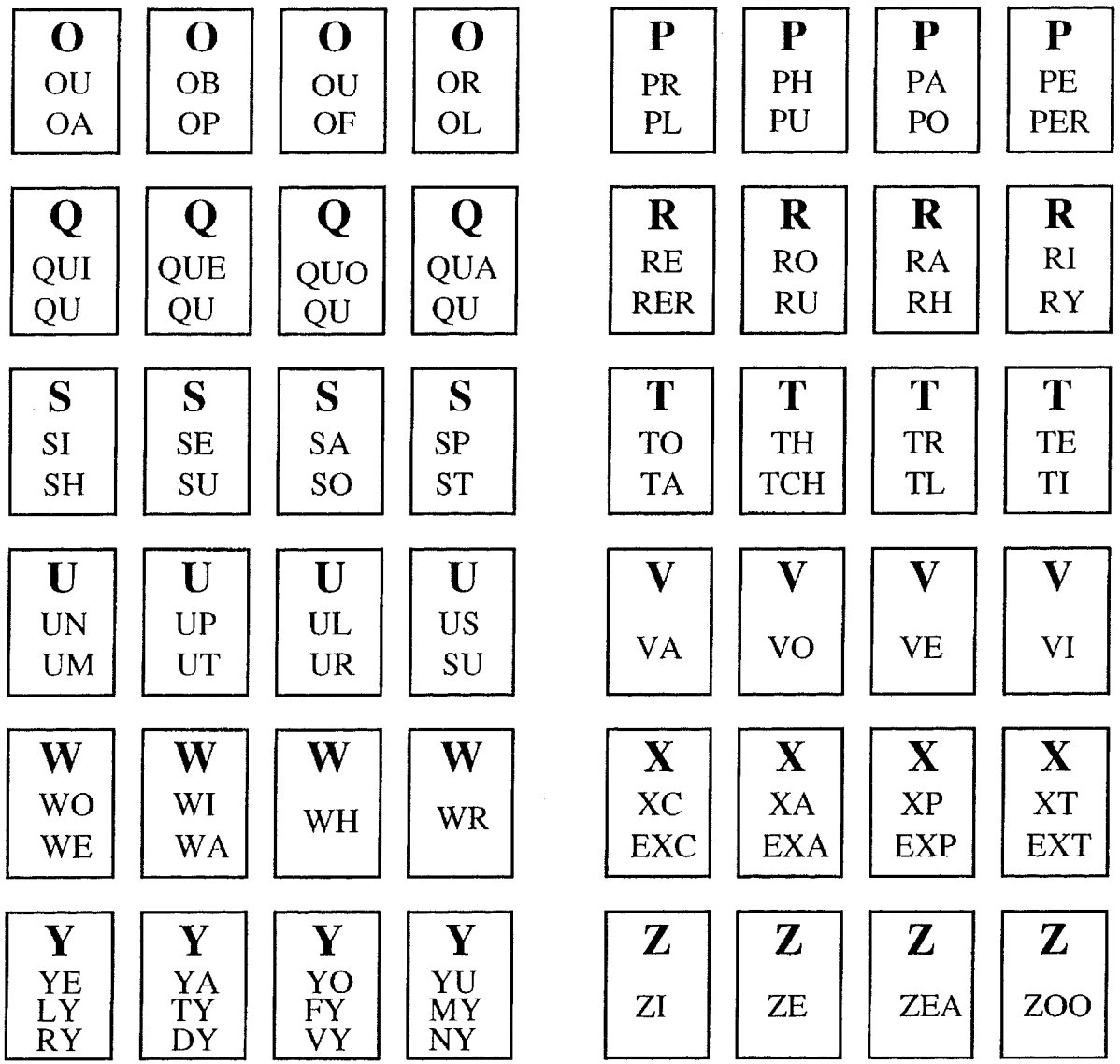
FIG. 4(*a*) and (*b*) illustrate a set of basic elements totaling 104 pieces.

Referring now to FIG. 4, there is shown a complete set of basic elements, totaling 104 pieces. An element is meant herewithin a block or a playing piece having the wording group information displayed on the element. The basic elements comprise the English 26 alphabets. None of these elements are identical. Each element has a first wording group comprising one of the 26 alphabets, and one, two or three wording groups comprising the most commonly used wording alphabets.

Figure 5:
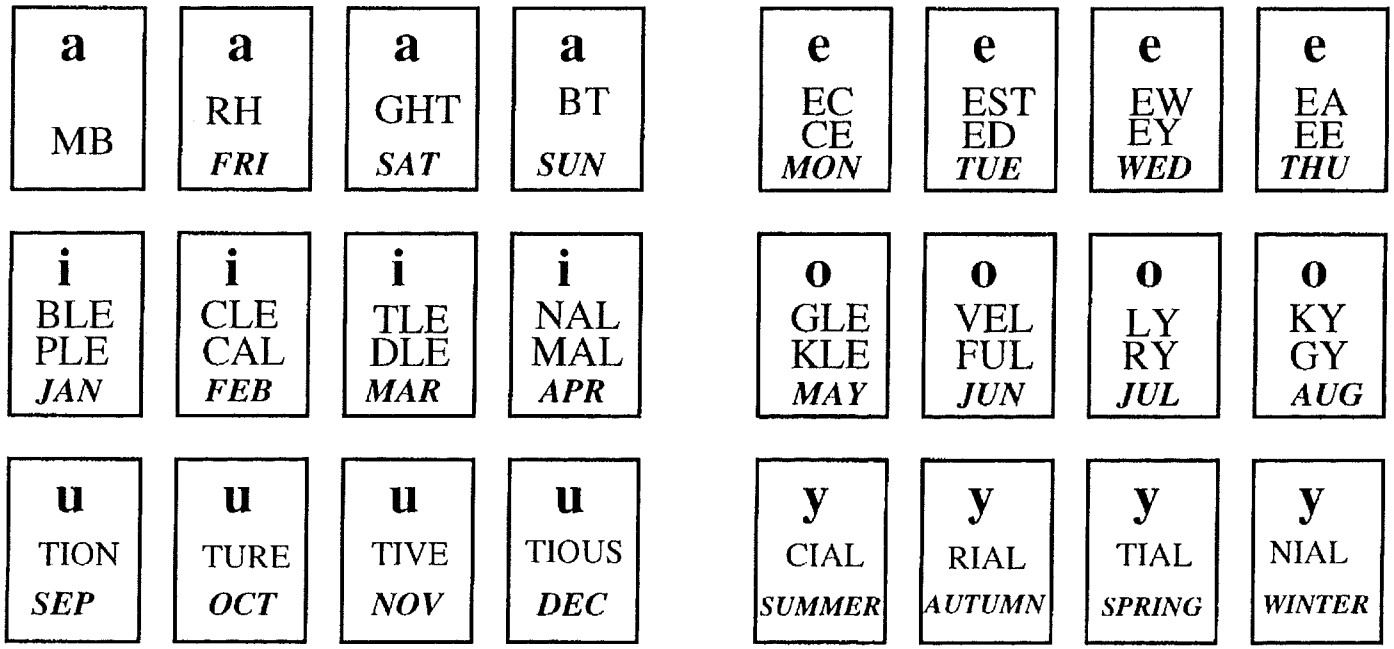
FIG. 5 illustrates a set of time elements totaling 24 pieces.

Referring now to FIG. 5, there is shown a complete set of time element, totaling 24 pieces. Each of the time elements is identified by a vowel, preferably in small letter to differentiate from the basic elements. The use of them in composing a word is the same as the basic elements, yet they are the most common alphabets appearing in an English word. In other words, the number of the elements having the six alphabets is doubled. These specially designated elements posses time characteristics as shown in the last wording group in addition to the regular wording groups between the vowel as an identifier and the last wording group. The last wording group in each of the time elements except only one comprises a time concept, such as the day of the week, the month and the season of the year. The total number of the day, month and season used in the current embodiment is 23, thus leaving one time element unidentified therefor.

Figure 6:
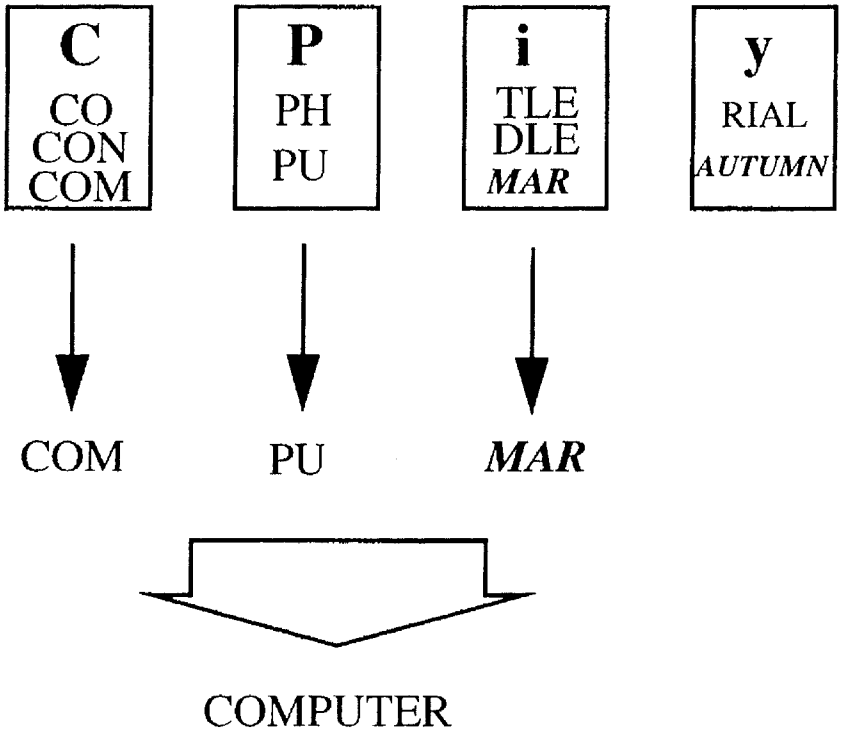
FIG. 6 demonstrates three blocks out of four blocks used in composing an English word "COMPUTER".

The utilization of the time elements make the game more challenging. Not only do the time elements provide one or two regular wording groups comprising the commonly used prefixes, roots or suffixes, they provide a time concept in composing a word by substitution. For example, in composing a word "computer" based on a rule of three pieces only. A player has received the following four piece as shown in FIG. 6. Element "C" provides a wording group "corn" in the forth wording group, element "P" provides a wording group "pu" in the third wording group, none of the other two can immediately conclude the spelling. If the game is played in March, then element "i" can be redefined to be "ter", namely "MAR" substitutes "ter". Element "y" is also subject to the redefinition, yet the time concept displayed thereon is Autumn. If the time element can not be used as a substitute one, it can be only used as a basic element of which one of the wording groups has to be part of a word. Thus the elements "C", "P" and "1" complete the spelling of "computer".

Figure 7:
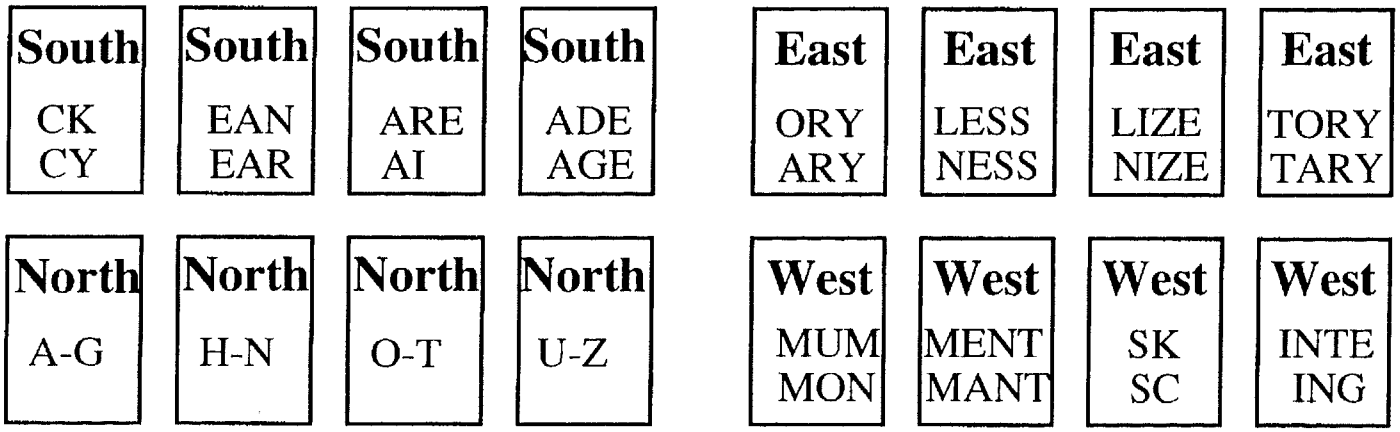
FIG. 7 illustrates a set of space elements totaling 16 pieces.

Referring now to FIG. 7, there is shown a complete set of the space elements, totaling 16 pieces. The first wording group of each element is identified by a space orientation. The purpose of this set is to provide each individual player with his own advantage over others. In other words, an unwanted space element in one player's hand can be a very desirable one by the opposing party. For example, if player A is defined to sit towards East, then elements bearing "South", "North", and "West" become a burden to him if he can not use them as the basic elements in composing a word. Only the elements bearing "East" can be used flexibly and indirectly in composing a word as described in using the time elements, namely the elements can be redefined to substitute the missing alphabets. However, to dispose the unwanted one can be a cautious step. If the opposing party desires a element "West", disposing the element "West" will certainly help the opposing party to win the game. Thus how to deal the space elements become strategically involved.

It should be noted that the four space elements "North" of which the second wording groups are different from other provide a single letter substitution with a predefined range displayed thereon. To be more specific, "A–G" means any letter in a group consisting of "A", "B", "C", "D", "E", "F" and "G", "H–N" means any letter in a group consisting of "H", "1", "J", "K", "L", "M" and "N", "0–T" means any letter in a group consisting of "0", "P", "Q", "R", "S" and "T", and "U–Z" means any letter in a group consisting of "U", "V", "W", "X", "Y" and "Z".

Figure 8:
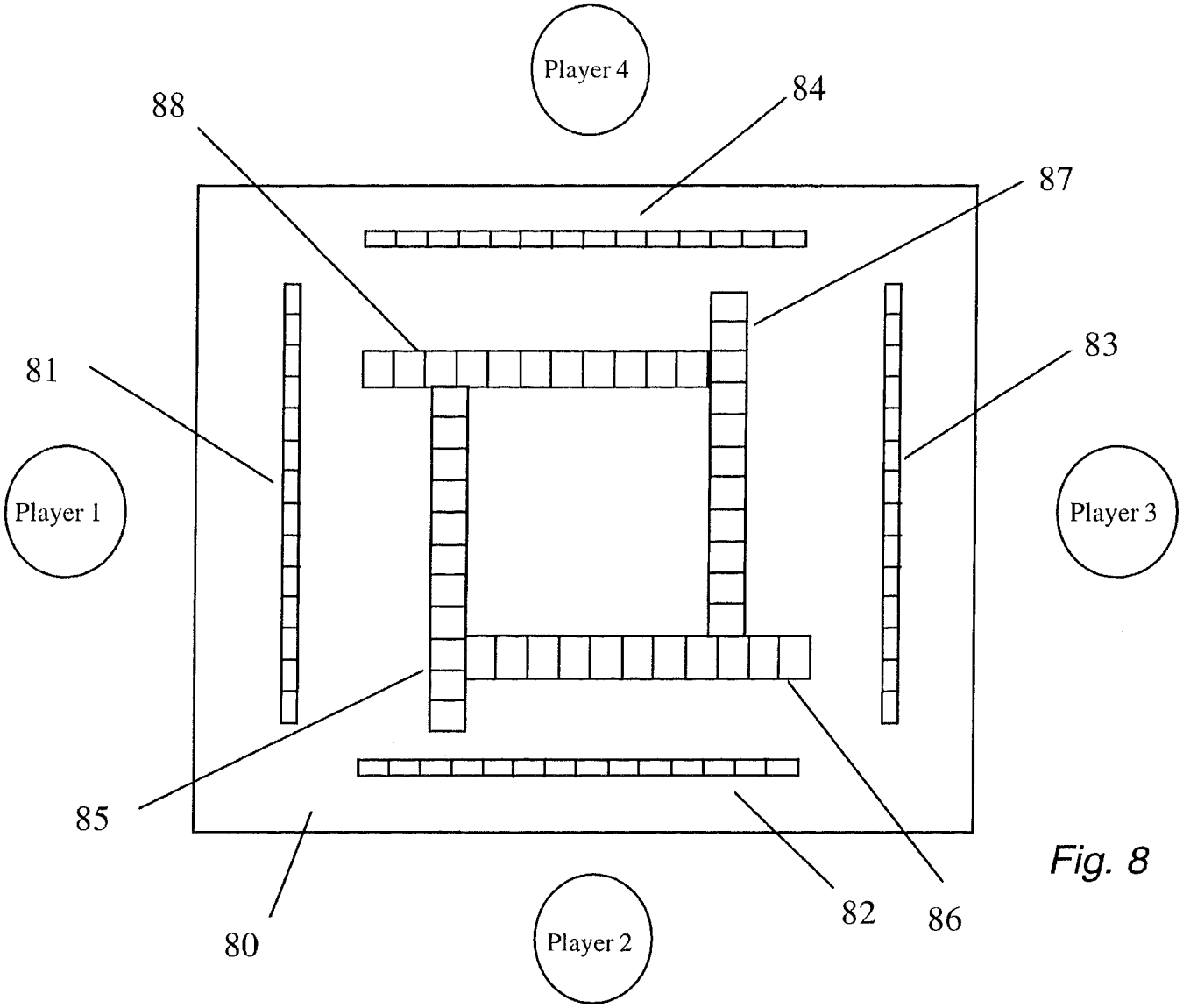
FIG. 8 shows a position of four players, each having a row of 14 blocks received, and a pool of 88 shuffled blocks in the middle.

Referring now to FIG. 8, there is demonstrated an overview of four players' positions and the playing blocks in the beginning of a game. The players, named Player 1, Player 2, Player 3 and Player 4, sit around a table with a flat surface, preferably of a square shape. Each of the players sits on one side and can be assigned to an orientation therefor. For example, Player 1 is West, Player 2 is South, Player 3 is East and Player 4 is North. Those space elements once received by the players having the same orientation will have the flexibility of substituting other needed alphabets but remain as the basic elements with the regular wording group thereof if the orientation thereon is different from the player's defined.

All playing blocks are initially mixed up or shuffled with the front surfaces facing downward. Each player collects 14 initial blocks from the shuffled pool of blocks in the center of the table. Since the front surfaces of all the blocks face downward, no players know what the pieces have been received. The 14 blocks are then aligned side by side, still with the front surfaces facing downward. The four players taking in total of 56 blocks from the 144 shuffled blocks leave 88 blocks intact. To facilitate the subsequent dealing, all players participate the arrangement of all the remaining 88 shuffled blocks.

The 88 shuffled blocks are divided into four parts for each player to set up an aligned row comprising 22 pieces as indicated by 85, 86, 87 and 88. To make the length of the block line fairly short, it is preferred to have a row of two layers, therefore each aligned row has 11 blocks on another 11 blocks, one on one. The preferred pattern of positioning the four rows is displayed in FIG. 8, called public pool. In playing the game, players take turns taking a new one from one of the rows. It can be understood any row can be started since none of the blocks are known to any players.

Once the public pool is set up, each player flips his own row of 14 blocks up and keeps the front surfaces of the blocks from the views of the other players as indicated as 81, 82, 83, and 84 in FIG. 8. Therefore, a player only has knowledge of his own received blocks. To compose words with the received 14 blocks, a rule should be defined in advance. In general, a rule of 3-2 or 4-2 is used. A rule of 3-2 means that four sets of 3 blocks and one set of 2 blocks are used to compose five words. In other words, an English word composed must consist of either 3 blocks or 2 blocks. To be more specific, a player wins the game if he completes 5 English words with 4 words consisting of 3 blocks each and 1 word consisting of 2 blocks. Similarly a rule of 4-2 means 4 English words with 3 words consisting of 4 blocks and 1 word consisting of 2 blocks. The use of the 2-block for a word can be appreciated in playing the game.

Figure 9:
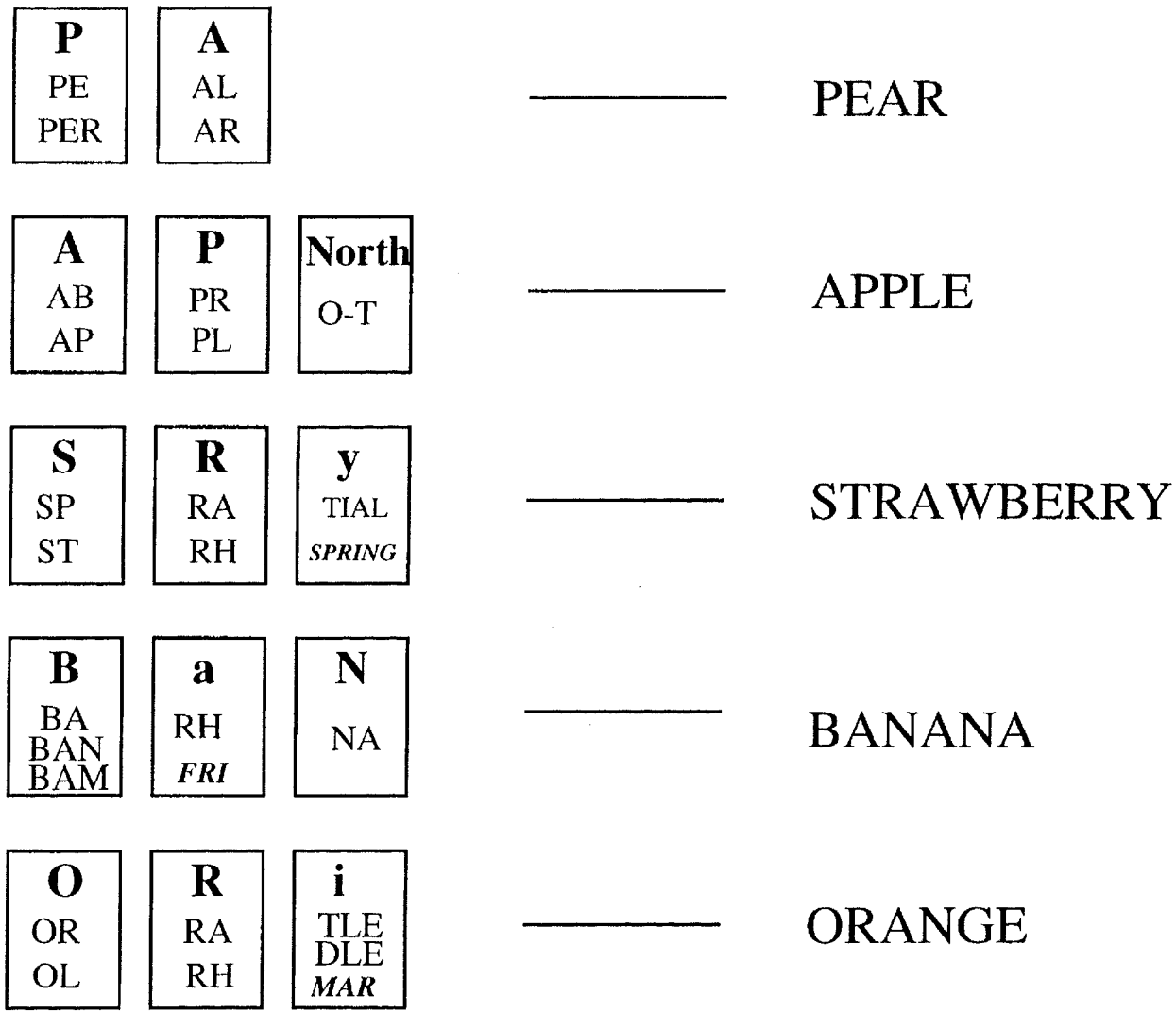
FIG. 9 shows a complete sample set of composed words in fruit category.

Referring now to FIG. 9 there is demonstrated a complete pattern of composed words based on the rule of 3-2. These five composed words are in the category of fruit. In real games for fun or gamble, players can restrict the composed words in certain category or predefined words to make the game more challenge. The demonstrated complete pattern is based on the following assumption: a player who has this complete set is assigned North and the game is played on Sunday, in March and Spring. Therefor a block bearing "NORTH" will serve the player interest and can be used as substituting alphabet "E". Similar to two other time blocks "Mar" and "Spring" bearing the right time concept, these blocks are used as substituting blocks. The first set of 2 blocks spells "PEAR" with "PE" from the block "P" and "AR" from the block "A". The second set of 3 blocks spells "APPLE" with "AP" from the block "A", "PL" from the block "P" and "E" from the substituting block "North". It is noted the "North" block is used as a "E" since the defined alphabets ranges is from "0" to "T". The third set of 3 blocks spells "STRAWBERRY" with "ST" from the block "S", "RA" from the block "RA" and "WBERRY" from the substituting block "y" which bears a right time "SPRING". The forth set of 3 blocks spells "BANANA" with "BAN" from the block "B", "A" from the block "a" and "N" from "N". It may be noted that the time block "a" is used as a basic block since the block does not bear the right time as the game is played. The last set of 3 blocks spells "ORANGE" with "O" from the block "O", "RA" from the block "R" and "NGE" from the time block "I" used as a substituting block.

To demonstrate the dealing process in playing the game, several steps based on the foregoing assumption is described in detail. The foregoing assumption is restated:

- the game is played by four players, named Player 1, Player 2, Player 3 and Player 4, each is assigned WEST, SOUTH, EAST and NORTH;
- the game is played on Sunday, in March and Spring;
- the acceptable composed words must be in the category of fruits and the rule of composing words is based on 3-2.

Figure 10A:
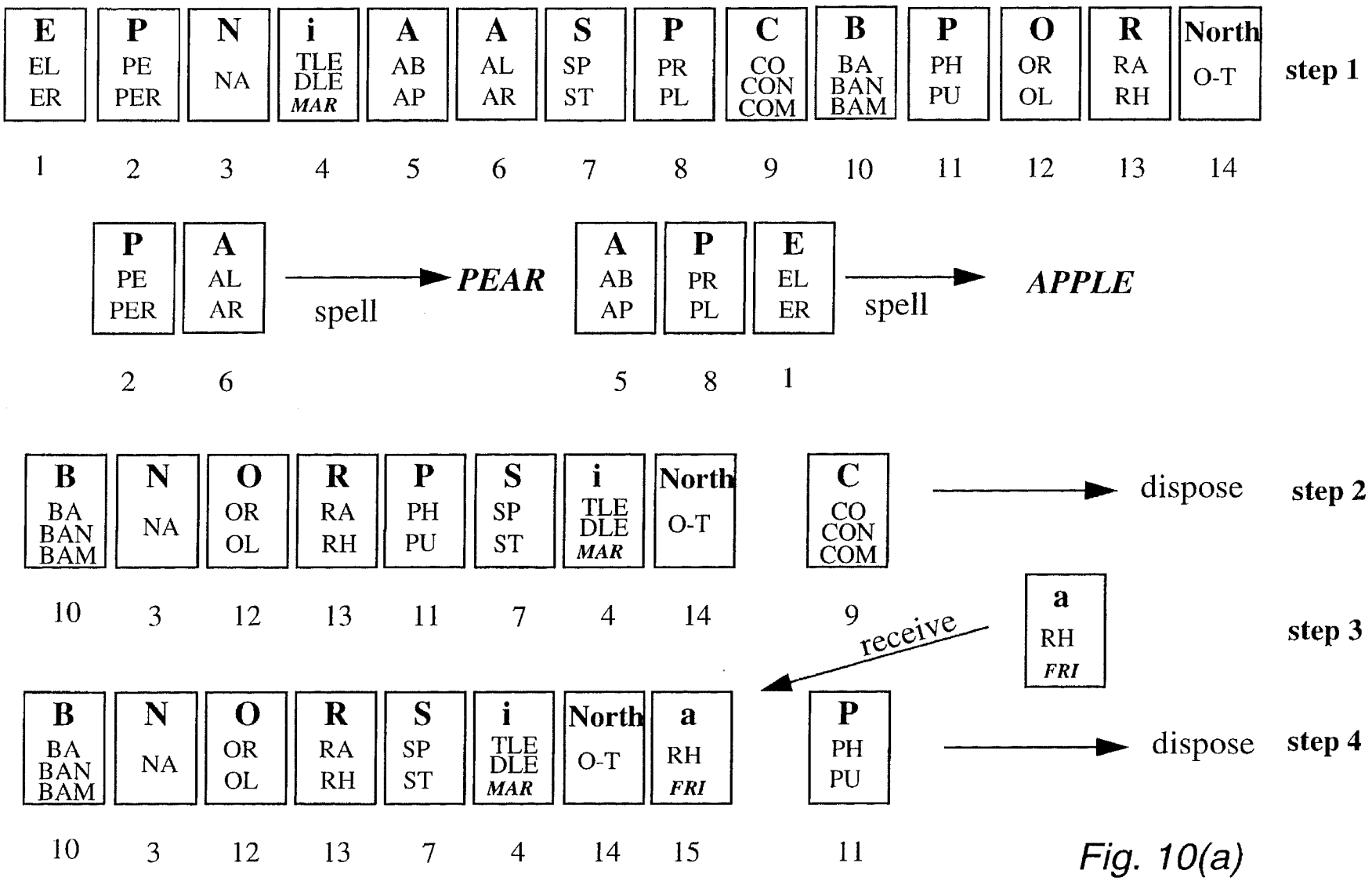
FIG. 10 (*a*), (*b*), and (*c*) illustrate an initial set of received blocks and a process of composing words in dealing the received blocks.
Figure 10B:
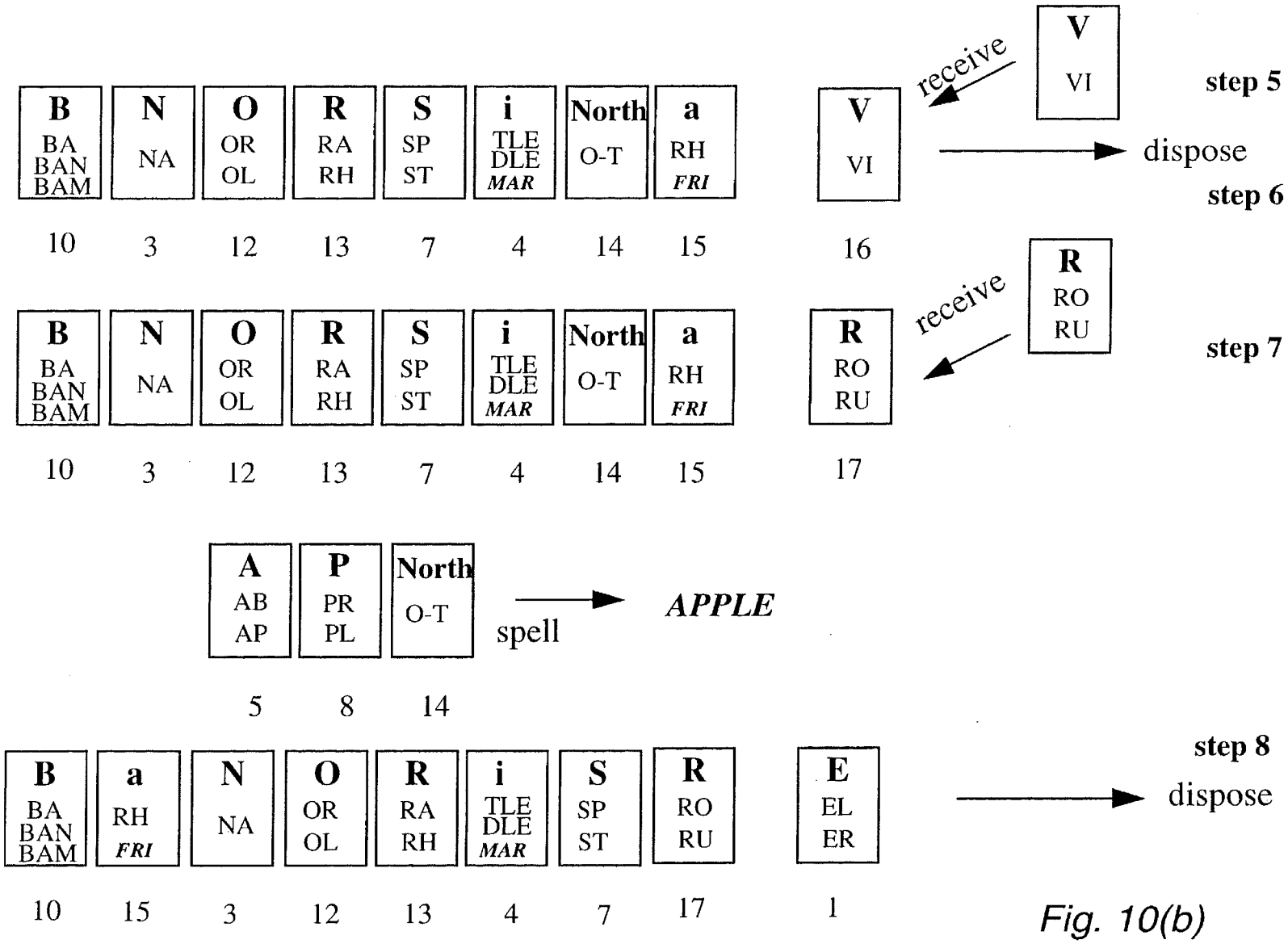
Figure 10C:
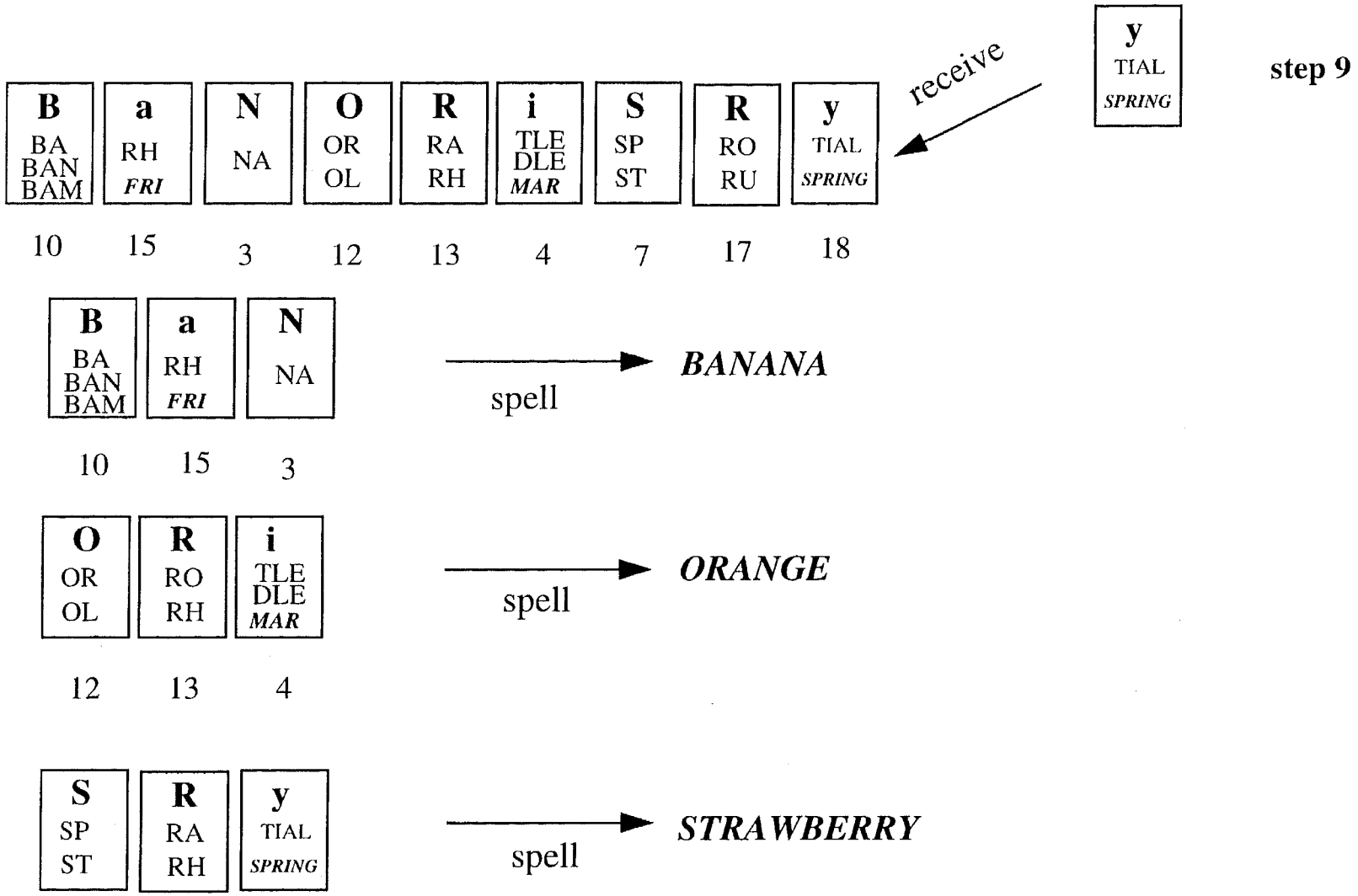

After each player received the initial 14 blocks and the public pool is set as depicted in FIG. 8, Player 4 flips up his received 14 blocks as shown as step 1 in FIG. 10(*a*). For easy illustration, each of the received blocks is labeled from 1 to 14 respectively. At first glance, Player 4 can compose a word "COME" by using the blocks 9 and 1. Although "COME" is a valid English word, one of the foregoing assumptions limits the composed word to fruit category. It can be appreciated that the use of a restricted word category makes the game more challenging. A careful planning reveals that the blocks 2 and 6 can be combined to spell "PEAR", the blocks 5, 8 and 1 can be combined to spell "APPLE". After repositioning the blocks for potential words, such as moving the block 3 next to the block 10 for a possibility of "BANANA", Player 4 has to decide which block has the least possibility to be used in the subsequent word composing. In the current received blocks, the block 9 is selected as step 2. Regardless of what blocks that Player 1, Player 2 or Player 3 has, it is assumed that the block that Player 3 does not want is not what Player 4 desires. When Player 3 discards his unwanted one, it must be placed in the public pole and shown to the rest of the players. But only the immediate following player, in the current case, Player 4 has the right to take the unwanted one by Player 3 if Player 4 deems it an appropriate one. If the Player 4 does not want it too, then the unwanted one by Player 3 is discarded and can not be used any more. Thus Player 4 takes a new one, assigned as block 15, from the public pool as step 3. The block 15 happens to be the time element, it should be in general kept as it has the flexibility of substituting others. The next one Player 4 is to disposes is the block 11 as step 4. It does not matter to Player 4 if Player 1 takes the block 11 or not since the discarded one by Player 4 does not bear the substitute flexibility, Player 4 just wants to receive a new one. Player 4 finds the new one, assigned as block 16, just received as step 5 has no impact on the existing blocks and therefore decides to disposes it for another new one as step 7. The new one received assigned as 17 makes it necessary to determine which one to be discarded next. Player 4 at this time begins to reorganize the existing composed words, moving the block 14 to the place of the block 1 which is determined to be the next to dispose. After repositioning the blocks, Player 4 now has the spelled word "APPLE" consisting of the blocks 5, 8 and 14. At step 8, Player 4 disposes the block 1 and receives a new one which happens to be the time element as step 9. The general strategy to play the game is to keep as many as the time or space elements as possible because the elements provide the substitute flexibility. Now player 4 has all together three space or time elements, which usually providing a very good opportunity to reorganize the blocks. Player 4 finally gets the complete result as depicted in FIG. 10. An arrangement of the five composed words is also depicted in FIG. 8. Thus Player 4 announces the wining of the game provided that players 1, 2, and 3 are still in the process of composing words.

For gambling purposes or accumulating points, the number of letters in a word determines the score. Referring now again to FIG. 8, "PEAR" is worth 4 points, "APPLE" is worth 5 points, "STRAWBERRY" is worth 10 points, "BANANA" is worth 6 points and "ORANGE" is worth 6 points. So Player 4 gains 31 points (4+5+10+6+6) in total. It can be appreciated that the longer a word is, the more points it is worth, yet the more difficult to compose such word.

Although the present invention has been described in considerable detail with reference to certain embodiment thereof, other versions are possible. For example, the blocks can be replaced by cards and other physical formats. In addition, the blocks in electronic formats are possible for single player to play against computers for gambling purposes. It is understood to those skilled in the art that the playing rules can be altered to meet individual players' need and various gaming purposes. One typical example is for kids to play the game. Instead of composing English words, kids can compose immediate letters based on the rule of 3-2 or 4-2, such as AB, FGH, etc. Therefore, the spirit and scope of the appended claims should not be limited to the description of the preferred embodiment contained herein.

What is claimed is:

1. A playing apparatus for composing words by at least two players, at a playing time, each being assigned an unique direction defined by a compass, the playing apparatus comprising a set of playing pieces, each having a first surface and a second surface, said first surface of each of said playing pieces having a plurality of wording groups, each of said wording groups comprising a plurality of letters, at least one of the wording groups, being identified as an indicative wording for distinction of said playing pieces, comprising a word from a basic group comprising alphabetic letters and combination of at least two of the alphabetic letters, a vowel group comprising a plurality of letters and indicia identifying different periods of time during a calendar year and a space group comprising directional wordings defined by the compass, said playing pieces with the indicative wording from the vowel group and the space group being given a substitution power to substitute missing letters in composing words when the indicative wording matches the playing time and the unique direction assigned to each of the players, respectively, whereby each of the players has an equal chance to the time sensitive playing pieces and advantageous directional playing pieces over others, said second surfaces of said playing pieces having a substantially identical graphics with an inherent orientation therein for undistinction of said playing pieces when said second surfaces of said playing pieces are displayed.

2. A method for a group of players to practice word composition using a set of playing pieces at a playing time, each of the players being assigned to a unique direction defined by a compass, each of said playing pieces having a first and a second surface, each of said first surface having a plurality of wording groups, at least one of the wording groups, being identified as an indicative wording for distinction of said playing pieces, comprising a word from a basic group comprising alphabetic letters and combination of at least two of the alphabetic letters, a vowel group comprising a plurality of letters and indicia identifying different periods of time during a calendar year and a space comprising directional wording defined by the compass, said playing pieces with the indicative wording from the vowel group and the space group being given a substitution power to substitute missing letters in composing words when the indicative wording matches the playing time and the unique direction assigned to each of the players, respectively, whereby each of the players has an equal chance to the time sensitive playing pieces and advantageous directional playing pieces over others, said method comprising the steps of:

(a) mixing said playing pieces with said first surfaces facing downward;

(b) receiving a predefined number of said playing pieces from said mixed playing pieces and keeping said first surface of each received playing piece from the view of the rest of players;

(c) arranging said received playing pieces based on a predetermined number of pieces required to compose a word, said word being from a commonly acknowledged word category and predetermined gaming level;

(d) identifying said received playing pieces with the indicative wordings from the vowel group and space group respectively by recognizing and matching the playing time and each assigned direction, hence said received playing pieces becoming playing pieces;

(e) using said received substituting playing pieces having (the) substitution power to substitute missing letters in composing words; and (f) declaring a wining if said received playing pieces are all used to compose the predefined number of words.

3. The method as recited in claim 2, further comprising the following step after element "b":

setting up a public pool of said left-over mixed playing pieces after the predefined number of said playing pieces are taken.

4. The method as recited in claim 2, further comprising the following steps after element "d":

(a) deciding unwanted pieces from said received playing pieces, the unwanted pieces being the ones which can not be used to compose words even with the help of the playing pieces with the substitution power;

(b) disposing one of the unwanted pieces at one time;

(c) receiving a new piece from said public pool; and (d) rearranging said received playing pieces based on the predetermined number of pieces required to compose a word in the commonly acknowledged word category and predetermined gaming level.

5. The method as recited in claim 2 wherein the step (d) further comprises the steps of:

(a) identifying the assigned direction to each of the players;

(b) using the playing pieces having the indicative wording from the space group, the indicative wording being the same direction as the one assigned, to substitute the missing letters in composing words; and (c) discarding the playing pieces having the indicative wording from the space group, the indicative wording being the different direction from the one assigned and the discarded playing piece offering no substitution power to the opposing players.

* * * * *